US005330016A

United States Patent [19]

Paske et al.

[11] Patent Number: 5,330,016

[45] Date of Patent: Jul. 19, 1994

[54] DRILL BIT AND OTHER DOWNHOLE TOOLS HAVING ELECTRO-NEGATIVE SURFACES AND SACRIFICIAL ANODES TO REDUCE MUD BALLING

[75] Inventors: William C. Paske, Missouri City; Paul F. Rodney, Spring; Ronald D. Ormsby, Houston, all of Tex.

[73] Assignee: Barold Technology, Inc., Houston, Tex.

[21] Appl. No.: 60,182

[22] Filed: May 7, 1993

[51] Int. Cl.[5] ..... E21B 17/00

[52] U.S. Cl. ..... 175/320; 175/425

[58] Field of Search ..... 175/325.5, 65, 374, 175/430, 420.1, 425; 166/65.1, 902

[56] References Cited

U.S. PATENT DOCUMENTS

| | | | |
|---|---|---|---|
| 3,762,485 | 10/1973 | Chesser et al. | 175/65 |
| 3,788,407 | 1/1974 | Lorenz et al. | 175/307 |
| 4,119,511 | 10/1978 | Christensen | 175/19 X |
| 4,185,706 | 1/1980 | Baker, III et al. | 175/340 |
| 4,187,921 | 2/1980 | Garner | 175/340 |
| 4,673,044 | 6/1987 | Bigelow et al. | 175/430 |
| 4,856,601 | 8/1989 | Raney | 175/393 |
| 4,883,132 | 11/1989 | Tibbitts | 175/65 |
| 4,913,244 | 4/1990 | Trujillo | 175/65 |
| 5,216,917 | 6/1993 | Detournay | 175/39 X |

*Primary Examiner*—Ramon S. Britts
*Assistant Examiner*—Frank S. Tsay
*Attorney, Agent, or Firm*—Browning, Bushman, Anderson & Brookhart

[57] ABSTRACT

Various steel, downhole tools and components of a drill string, including, as examples, a PDC drill bit, a rotary rock bit, a cross-over sub, a stabilizer, a reamer, a hole enlarger and a coring bit, are selectively treated to cause certain of their parts to be electro-negative with respect to steel, and certain other parts to either have the same electro-negativity as steel, or to be treated to be electro-positive with respect to steel.

59 Claims, 5 Drawing Sheets

DRILL BIT AND OTHER DOWNHOLE TOOLS HAVING ELECTRO-NEGATIVE SURFACES AND SACRIFICIAL ANODES TO REDUCE MUD BALLING

BACKGROUND OF THE INVENTION

The present invention relates, generally, to drill bits and other downhole tools used for the drilling of oil and gas wells, and also relates to methods for manufacturing same. Such bits and other downhole tools are used in drilling earth formations in connection with oil and gas exploration and production.

DESCRIPTION OF THE PRIOR ART

It is well known in prior art drill bits to use cutting elements having on one end thereof a plurality of polycrystalline diamond compacts, each generally referred to as a "PDC". The PDC material is typically supplied in the form of a relatively thin layer on one face of a substantially larger mounting body. The mounting body is usually a stud-like end configuration, and typically is formed of a relatively hard material such as sintered tungsten carbide. The diamond layer may be mounted directly on the stud-like mounting body, or it may be mounted via an intermediate disc-like carrier, also typically comprised of sintered tungsten carbide. In any event, the diamond layer is typically disposed at one end of the stud-like mounting body, the other end of which is mounted in a bore or recessed in the body of the drilling bit.

The bit body itself is typically comprised of one of two materials. The body is either a tungsten carbide matrix, or is made of various forms of steel. When the body is made of steel, the pocket for receiving the stud is usually in the shape of a cylinder to receive the cylindrically shaped stud of the cutter.

It is also well known that when such bits are used to drill certain earth formations, for example, hydratable limestones or shales, the drill cuttings tend to adhere to the bit bodies, an event generally referred to in the art as "bit balling". Bit balling can drastically reduce drilling efficiency.

Prior art explanations are generally presented in terms of either mechanical or chemical terms without providing the necessary and sufficient conditions (mechanisms) as to when a given shale will or will not ball. Mechanical factors most often mentioned are flow rate versus cuttings production rates (kinematic processes), mechanical packing of the cutting, fluid transport of the cuttings, whether or not the jets are leading or trailing jets, etc. Chemical factors include the wetting ability of the cutting surfaces, allowing the cuttings to stick, differential sticking due to swelling of the cuttings, and the reactivity of the clay (cation exchange capacity).

In the discussion of jets, the electrical charging processes which are usually present are most often not even mentioned. In general, the materials used to construct the jets versus the cutters or the body of the bit are seldom mentioned, implying the relative electronegativity of the materials is not considered important. Jet velocity and total flow coupled with weight on bit (WOB) are commonly considered by some authors as the only operative mechanisms of importance.

None of these mechanical and/or chemical descriptions are capable of predicting whether bit balling will or will not occur. Studies made to determine what factors correlate with bit balling contradict other studies as no consensus has been reached as to why bit balling occurs. While some of the variables appear to be necessary for the formation of bit balling, they are not sufficient for the formation of bit balling. The actual mechanism has been most elusive.

It has been well known in the prior art that applying a negative charge to a rod with respect to the earth will allow easier penetration of the earth, especially in clays. Modification of the soil surrounding a charged pipe has also been studied.

E. H. Davis and H. G. Poulos, in an article entitled "The Relief of Negative Skin Friction on Piles by Electro-Osmosis", NTIS PB80-213234, May 1980, provide a discussion of the importance of electro-osmosis on a pile with respect to the load bearing capacity and the downdrag responsible for settlement of the pile. They also discuss the reduction of the penetration resistance of the pile during installation achieved via the application of a current to the pile.

The concept of electro-osmosis is also addressed by R. Butterfield and I. W. Johnston, "The Influence of Electro-osmosis on Metallic Piles in Clay', Geotechnique, 30, 1,17–38, 1980, in a very thorough paper concerning metal piles being jacked into the earth. In their discussion of the penetration resistance of the piles as a function of applied currents and the polarity of the current, they discuss what they believe is the mechanism for the increased load capacity experienced for the metallic piles. The effect was attributed to electrochemical "hardening" of the clay surrounding the pipe.

R. Feenstra and J. J. M. Van Leeuwen, "Full-Scale Experiments on Jets in Impermeable Rock Drilling", JPT 329–336, March 1964, discuss bit ball prevention in terms of tooth scavenging or jet action. They assert that bit balling did not occur at low bit loads . . . implying that bit balling can not or does not occur while the string is in slips. They further conclude that high velocity fluid flow is required in front of the teeth where the chips are generated in order to reduce bit balling. No discussion is made concerning the mechanism required to induce bit balling in the first place. Electrochemistry is not discussed nor is the charging of the teeth due to the impingement of the drilling fluid on the teeth due to the jet flow considered as important. Materials used in the construction of the jets are not discussed (relative electro-negativity) . . . only the direction in which the jets are aimed was deemed important.

D. H. Zijsling and R. Illerhaus, "Eggbeater PDC Drillbit Design Concept Eliminates Balling in Water-Base Drilling Fluids", SPE/IADC 21933, March 1991, discuss the development of a PDC bit to reduce the balling of the bit in water based muds. The mechanisms of the balling process are discussed in terms of the size of the cutting, flow anomalies, and the cutter locations. The field tests indicate that the new bit design does in fact reduce bit balling. When the authors discuss the reduced sticking of the cuttings to the bit surface, they consider the equilibration of the pressure differential (due to varying moisture content) across the cutting as the mechanism which provided the sticking. Therefore, larger cuttings produced by their bit design reduces the sticking. However, there are a few salient points overlooked by the authors as to why the bit balling was not observed. First, the jets were designed to impact the bottom in front of the cutters. This contradicts the findings of Feenstra and Van Leeuwen who teach that you get less balling by impacting the cutters and begs the question of charging or lack of charging caused by the jets. Second, the three open blades are covered by a larger percentage of tungsten carbide matrix to provide erosion resistance. This coupled with the use of polyanionic muds hints at a relative electro-negative charging of the bit, again overlooked by the authors.

L. W. Ledgerwood III, D. P. Salisbury, "Bit Balling and Wellbore Instability of Downhole Shales", SPE 22578, October 1991, discuss bit balling from the viewpoint of the drilling mud. These authors state that the type of cations present are critical, whereas cation exchange capacity and moisture content are not directly correlatable to bit balling, contradicting Zijsling and Illerhaus. These authors state that the ability of the clay to release water and form a compact ball is a necessary but not sufficient condition for bit balling. Their study suggests that presence of calcium cations can influence the occurrence of bit balling, but . . . "There are other criteria, yet unidentified, which are required to guarantee that the compacted shale will form a ball". These conclusions are based on the observations that previously reported balling mechanisms did not correlate with the observed water based mud tests. They did find correlation based on the presence of soluble calcium.

In a Preliminary Report (date unknown) entitled REDUCTION OF BIT BALLING BY ELECTRO-OSMOSIS published by S. Roy and G. A. Cooper, Petroleum Engineering Department of Materials Science and Mineral Engineering, University of California, Berkeley, Calif., there is some discussion of preliminary work performed in the laboratory which might lead to the application of a negative charge to the drill bit during the drilling operation through clay formations to reduce bit balling.

S. Roy and G. A. Cooper also published some preliminary results concerning the application of an electric current to a drill bit while drilling a test formation in the laboratory, observing that the action of making the bit the cathode with respect to the formation prevented the clay from sticking to the bit. This article is entitled PREVENTION OF BIT BALLING IN SHALES: SOME PRELIMINARY RESULTS, IADC/SPE 23870, February 1992.

In an earlier publication of S. Roy and G. A. Cooper entitled EFFECT OF ELECTRO-OSMOSIS ON THE INDENTATION OF CLAYS, ISBN 90 6191 194 X, Balkema, Rotterdam 1991, there is a discussion of bit balling being reduced by a thin layer of water created by the process of electro-osmosis.

However, the prior art totally fails to teach or suggest a practical solution for providing relative electro-negativity to a drill bit to reduce bit balling.

The primary object of the present invention is to provide a new and improved drill bit, at least portions of which are electro-negative with respect to other portions of the drill bit, or other portions of the drill string, to thereby reduce bit balling.

It is another object of the present invention to provide a new and improved method of manufacturing a drill bit having improved resistance to bit balling.

It is another object of the present invention to provide drill bits and various other downhole tools having surfaces tending to have a reduced amount of mud sticking in their critical areas, and an increased amount of mud sticking in their non-critical areas.

SUMMARY OF THE INVENTION

The objects of the invention are accomplished, generally, by the provision of new and improved downhole tools and drill string components for drilling oil and gas wells, comprising certain parts of steel which have been treated to be electro-negative with respect to steel, and certain other steel parts which either have the same degree of electro-negativity as steel, or which have been treated to be electro-positive with respect to steel.

DETAILED DESCRIPTION OF PREFERRED EMBODIMENT

Figure 1:
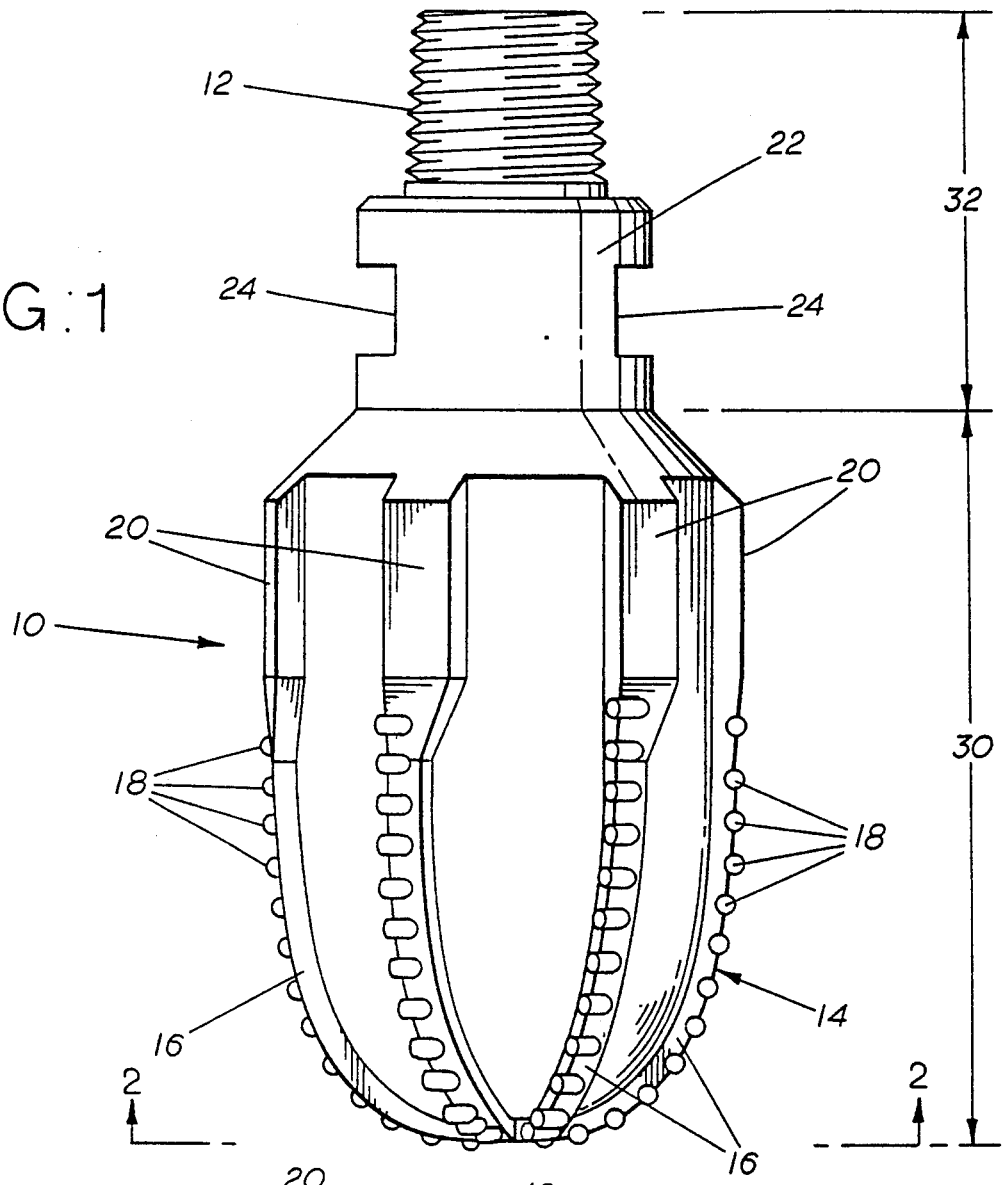
FIG. 1 is an elevated, pictorial view of a drill bit in accordance with the present invention.
Figure 2:
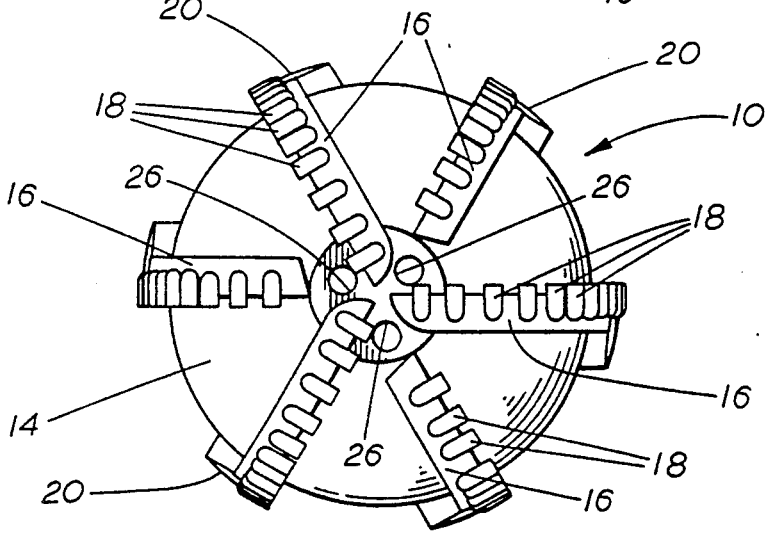
FIG. 2 is an end view of the working face of the drill bit in accordance with FIG. 1.

FIGS. 1 and 2 depict a drill bit of the type in which the present invention may be used. As used herein, "drill bit" will be broadly construed as encompassing both full bore bits and coring bits. Bit body 10, manufactured from steel or another hard metal, has a threaded pin 12 at one end for connection in the drill string, and an operating end face 14 at its opposite end. The "operating end face" as used herein includes not only the axial end or axially facing portion shown in FIG. 2, but contiguous areas extending up along the lower sides of the bit, i.e., the entire lower portion of the bit which carries the operative cutting members described herein below. More specifically, the operating end face 14 of the bit is transversed by a number of upsets in the form of ribs or blades 16 radiating from the lower central area of the bit and extending across the underside and up along the lower side surfaces of the bit. Ribs 16 carry cutting members 18, to be described more fully below. Just above the upper ends of rib 16, bit 10 has a gauge or stabilizer section, including stabilizer ribs or kickers 20, each of which is continuous with a respective one of the cutter carrying rib 16. Ribs 20 contact the walls of the borehole which has been drilled by operating end face 14 to centralize and stabilize the bit and to help control its vibration, thereby providing intermediate the cutting face 14 and the pin end 12 an exterior peripheral stabilizer surface.

The invention is described herein with respect to "steel", which by some definitions is intended to cover any alloy of iron and 0.02 to 1.5% carbon. However, steel is to be construed herein in its most generic sense and will include any hard metal which can be used in a drill string environment and which can be made to be electro-negative or electro-positive with respect to another part of the drill string.

Intermediate the stabilizer section defined by ribs 20 and the pin 12 is a shank 22 having wrench flats 24 which may be engaged to make-up and break-out the bit from the drilling string (not illustrated). Referring again to FIG. 2, the under side of the bit body 10 has a number of circulation ports or nozzles 26 located near its centerline, nozzles 26 communicating with the inset areas between rib 16, which areas serve as fluid flow spaces in use.

In accord with the present invention, the bit body 10 is processed to make it electro-negative with respect to steel either prior to, or after placing the cutting members 18 into the ribs 16.

There are a variety of processes to make the bit body 10 electro-negative with respect to steel, some of which will be described after the following discussion of relative electro-negativity.

The commonly accepted standard of electro-negativity is the standard hydrogen electrode. Thus, hydrogen ($H_2$) is defined as having a potential of exactly zero volts. Iron (or steel) has a potential of −0.037 E°, V. E° is the standard reduction potential, as measured in volts (V). The present invention contemplates causing either a portion of the drill bit, or the entire drill bit to be more electro-negative than steel. For the reasons discussed below, the drill bit, or selected portions thereof, should be more electro-negative than −0.037 E°, V.

Shale (clay) formations typically encountered in drilling oil and gas wells have high numbers of very mobile negative ions. The drill cuttings having these negative ions tend to stick or ball against the steel bodied drill bit, which although having a potential of −0.037 E°, V, is nonetheless positive with respect to such negative ions.

Referring again to FIG. 1, the present invention contemplates that the portion 30 of the steel bodied bit 10 will be processed to make it more electro-negative than the portion 32 of the bit 10 having the shank 22 and pin 12. During such processing, the shank 22 and pin 12 are masked off.

The preferred process for increasing the electro-negativity of the portion 30 of the bit 10 in FIG. 1 is to use the gas nitriding process, a well known process for case hardening steel. In a typical gas nitriding process, steel is gas nitrided in a furnace at 950° to 1050° F. with an atmosphere, commonly ammonia, that permeates the surface with nascent nitrogen. As an indication of the long period required, with SAE 7140 steel at 975° F. case depth reaches 0.02 in. at 50 hr and 0.04 in. at 200 hr. Liquid nitriding is done also at 950° to 1050° F. in a bath of molten cyanide salts. Quenching is not needed because the case consists of inherently hard metallic nitrides. For more efficient results, nitridable steels alloyed with aluminum, chromium, vanadium, and molybdenum to form stable nitrides can be used. The time required to reach a desired case depth will depend on the temperature and the particular steel or steel alloy. The gas nitriding process can be reapplied to the steel, causing the case depth to become deeper if desired.

In treating the bit body 10 with the gas nitriding process, in addition to masking off the shank 22 and pin 12, the holes in which the cutters 18 are later inserted are masked off using paste or so-called "copper paint" in a manner well-known in the art.

After the gas nitriding process is complete, the cutters 18 can be mounted in the ribs 16 in accord, if desired, with the teachings of co-pending U.S. application Ser. No. 07/995,814, filed Dec. 23, 1992, assigned to Baroid Technology, Inc., the assignee of this present application.

We have found that if the PDC cutters are mounted in the ribs prior to the gas nitriding process, some of the cutters, perhaps 20%, will tend to degrade or deteriorate. Thus, in practicing the present invention, the PDC cutters themselves should preferably be masked off during the gas nitriding process if already mounted in the bit body.

A series of tests were run to determine whether downhole tools could in fact be protected from the balling of mud in their critical areas. To prove that concept, we at first connected two aluminum pipes in a container or drilling fluid with one pipe being connected to the positive terminal of a battery to thus act as an anode and the other aluminum pipe being connected to the negative terminal of that same battery to act as a cathode. In those tests, we observed that the anode always had a very heavy mud cake which was very difficult to remove and frequently would not rinse off. The cathode, on the other hand, would be coated with heavily flocculated mud which was easily removed from that pipe. After running the experiment with a pair of pipes several times, we added a third pipe which was neutral, not being connected to either connection of the battery. With the current set at 0.64 amps at 9.4 volts, we noticed that after three minutes, there were bubbles and mud separation visible at the cathode. After about seven minutes, the neutral pipe, although initially coated with mud, was beginning to show mud separation. After 11 minutes, gas bubbles were observed on the neutral pipe when it sat next to the anode. After about 15 minutes, the pipes were lifted about 0.5 inch out of the mud tank to observe the subsurface conditions. The anode had about ⅛ inch of mud uniformly caked on the surface. It was smooth and did not readily show the electrolysis vents previously seen when washing the pipe after the experiments. The cathode was clearly flocculating the mud. The mud was runny and the surface of the cathode pipe was visible, without the normal mud coat. The neutral pipe was also clean. The neutral pipe did not show any flocculation and was cleaner than the cathode. After 20 minutes with the current cut off, the pipes were lifted out of the mud. The anode had a very uniform mud cake about 3/16 inch to ¼ inch thick. The neutral pipe was very clean. It had some slight flocculation present but the normal mud coating present when a pipe is placed in the mud was absent. The cathode was heavily flocculated. The mud slid off very easily as the pipe hung over the mud tank. It was with this type of system that we ran test bars in the container of drilling mud to determine which would be the preferred process for treating portions of a drill bit, or other downhole tool. The following tests were conducted to determine which test bars would be heavily balled by mud and which would be cleaner, i.e., would have a reduced amount of mud thereon:

EXAMPLE 1

A steel test bar (4330 H.T.) having holes for four (4) PDC cutters (2 conical, 2 stud) was subjected to the gas nitriding process at 1025°. The nitride depth was 0.030". 1 conical cutter and 1 stud cutter were installed in the test bar prior to the gas nitriding process. The two other cutters were installed after the furnace cycle to check the growth, if any, of the PDC hole diameters.

The test bar was then tested for balling in a container of drilling mud using the following parameters and using the test bar as an anode and a second steel bar as the cathode:

| | |
|---|---|
| Voltage: | 10 |
| Amperage: | .99 |
| Time: | 20 minutes |
| Mud Weight: | 14.0 ppg |
| Mud Type: | Barite |

Summary of Test Results

The test provided excellent results. The most interesting observation was the gas nitriding process in 4330 H.T. steel makes the test bar much more electro-negative than the carbide studs themselves, the carbide studs being part of the PDC stud cutters. In every example, we equate, inversely, the degree of sticking of the mud to an object with the degree of electro-negativity, i.e., the more negative, the less sticking.

EXAMPLE 2

A test bar similar to the test bar used in Example 1 was instead treated with an ion nitriding process, a well known process performed in a glow discharge vapor deposition unit. Although the test bar was initially quite electro-negative, it began to oxidize almost immediately, and lose its ability to reduce sticking of the mud. The tests were thus not as successful, indicating that the test bar, once oxidized, was less electro-negative than the test bar of Example 1 which was subject to the gas nitriding process.

EXAMPLE 3

Additional tests were run with a boronizing process to compare it with the gas nitriding process. The boronizing process involves higher temperature than the gas nitriding process and thus tends to deform portions of the steel parts, for example, the holes in the bit body in which the cutters are mounted.

In one of the tests involving the boronizing process, the following parameters were used:

| | |
|---|---|
| Material in test bar: | 4330 Annealed |
| Volts: | 8.0 |
| Amps: | 1.2 |
| Mud: | 13.5 ppg. |
| Time: | 20 minutes. |

Although the test bar cleaned up quite well, somewhat equivalent to the gas nitriding process, the test bar showed deformation from the high temperatures, and tended to oxidize (rust) almost immediately after the mud was removed.

EXAMPLE 4

A test bar having two (2) conical and two (2) stud cutters was subjected to the gas nitriding process. Prior to mounting the stud cutters in the test bar, the tungsten carbide studs were subjected to ion implantation to determine if the exposed portions of the tungsten carbide stud could be made more electro-negative by the gas nitride process and thus be more resistant to mud balling. The test parameters were as follows:

| | |
|---|---|
| Material: | 4330 H.T. |
| Volts: | 8.0 |
| Amps: | 1.2 |
| Mud: | 13.5 ppg. |

-continued

| | |
|---|---|
| Time: | 20 Minutes. |

The exposed portions of the tungsten carbide studs were observed as being more electro-negative than studs having no ion implantation pre-treatment.

We also observed an unexpected development, in which by hanging the test bar for 5–7 minutes before applying water pressure to clean up the bar, the mud would simply peel off while applying water pressure. This time period, 5–7 minutes, closely approximates the time for making a surface connection of another joint of drill pipe. Based upon this observation, the recommencement of circulation of drilling fluid past the drill bit, or other downhole tool similarly treated, should cause the mud to peel off and keep the drill bit or other downhole tool clean.

EXAMPLE 5

A steel test bar was partially hard faced (50% of its area) with 100% chromium boride, a product having 82% chromium and 18% boride. The product, commonly referred to as Colmonoy sweat on paste, is available from the Wall Colmonoy Corporation.

The test bar was tested using the following parameters:

| | |
|---|---|
| Material: | 4330 H.T. Steel |
| Volts: | 10 |
| Amps: | .6 |
| Mud: | 14.4 ppg. Barite |
| Time: | 20 Minutes. |

The test bar, although showing some increased electro-negativity over untreated steel, did not clean up nearly as well as the bars treated with the gas nitriding process.

Although the various experiments showed gas nitriding to be the preferred process, the other processes such as ion nitriding and boronizing will also cause steel to be electro-negative with respect to untreated steel.

Referring again to FIG. 1, the shank 22 and pin 12 are first masked off, and the remainder of the bit body 10 (absent the cutters 18) is subjected to the gas nitriding process, above described, to result in a case depth preferably of 0.02 to 0.04 inch. With the cutters 18 then mounted in the bit, the bit is ready for use in the drilling of oil and gas wells.

In the operation of the drill bit illustrated in FIG. 1, as the drill bit drills through clay or shale formations, because portion 30 of the drill bit is electro-negative with respect to the shank 22, the bit cuttings will tend to stick against the shank 22 and not against the remainder of the drill bit, thus keeping the bit free of mud balling. Thus, the shank 22 acts as a "sacrificial anode", although in a different sense than the term is normally used.

Sacrificial anodes are well-known as a means of protecting steel from corrosion in a number of environments. Sacrificial anodes have been used to protect the external and the internal surfaces of ships, offshore oil drilling platforms and rigs, underwater pipe lines, underground pipe lines, harbour piling and jetties, floating docks, dolphins, buoys, and lock gates, and many other industrial types of equipment where the surfaces are in contact with corrosive electrolytes. Chapter 11 of a book entitled CORROSION, Vol. 2, and subtitled "Corrosion Control", edited by L. L. Shreir, the head of the Department of Metallurgy and Materials, City of London Polytechnic, first published in 1963 by George Newnes Ltd., and reprinted in 1978, is directed to cathode and anode protection, with its subchapter 11.2 being dedicated to sacrificial anodes.

The general principle involved with sacrificial anodes includes an essential requirement that the anode will polarize the steel to a point where it will either not corrode at all, or corrodes at an acceptable rate, for an acceptable period of time at an acceptable cost.

The concept of using a sacrificial anode in a downhole environment to prevent, or at least to lessen the effect of mud balling on a drill bit or on another downhole tool is, to the best of Applicants' knowledge, not known in the art. Thus, we are using the term "sacrifical anode" in a different sense than it is used in the corrosion art. We have discovered that by making one portion of the bit more electro-negative than the sacrifical anode, the portion which has been so treated will remain essentially free of mud, thus encouraging the mud to be balled or caked against the sacrificial anode.

An alternative embodiment of the present invention involves a coating to the sacrificial anode which causes it to be electro-positive with respect to steel. Thus, in an alternative embodiment of the present invention, the portion 30 of the drill bit can be masked off, either before or after the gas nitriding process, and the shank 22 can be galvanized, for example, to make it electro-positive with respect to steel. This has the overall effect of making an even bigger electrical potential difference between the shank 22 and the remainder 30 of the drill to make the sacrificial anode even more efficient. Since the pin 12 is threaded into a cross-over sub or a well logging instrument as will be explained in more depth hereinafter, and is thus not exposed to the drilling fluid, it makes essentially no difference whether the pin 12 is coated. As a practical matter, to coat the pin 12 is to create the potential problem of making it more difficult to mate the threads of pin 12 with the cross-over sub.

The galvanizing of shank 22, assuming pin 12 has been masked off, can be easily accomplished by dipping the shank 22 into molten zinc in a manner well known in the art.

Figure 3:
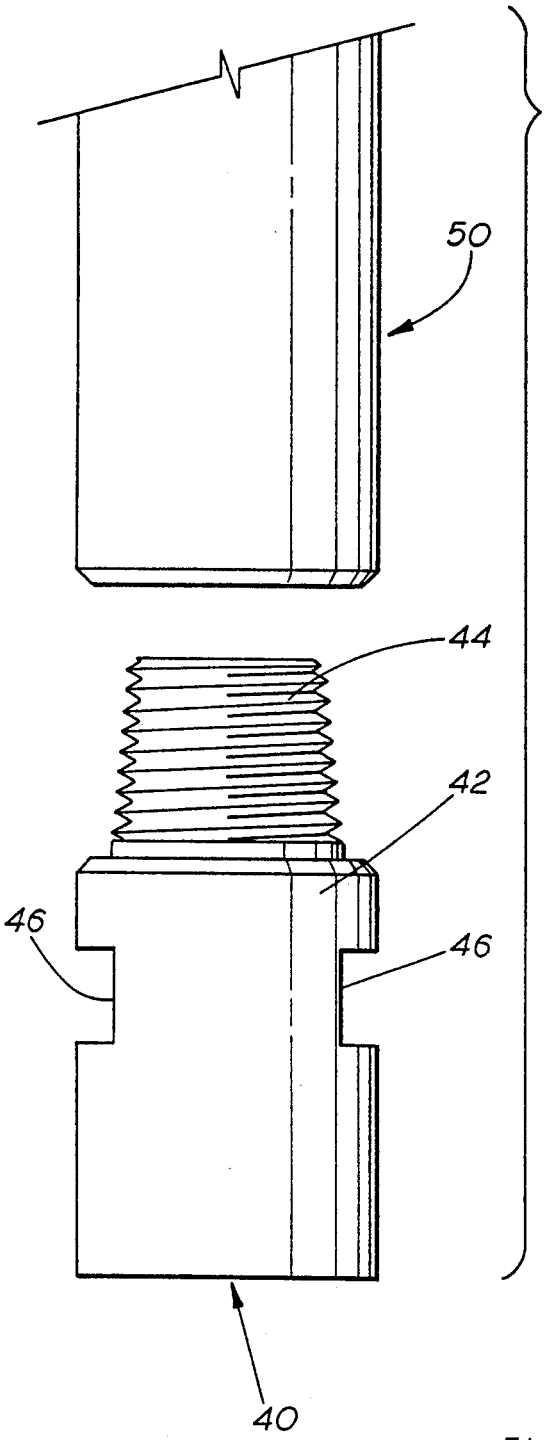
FIG. 3 is an elevated, pictorial view of a cross-over sub and a segment of an MWD logging tool in accord with the present invention.

Referring now to FIG. 3, there is illustrated an alternative embodiment of the present invention in which a cross-over sub 40 has a first box end, a pin 44 and a main body 42. The body 42 has flats 46 which facilitate the make-up of the cross-over sub with the drill bit and the conventional MWD logging tool 50. The cross-over sub 40 has a box end having female threads (not illustrated) for receiving the pin 12 of FIG. 1. The MWD logging tool 50 has a box end with female threads (not illustrated) for receiving the pin 44 of the cross-over sub 40. In this embodiment of the invention, the cross-over sub 40 is made electro-positive with respect to steel, thus causing the cross-over sub to be a sacrifical anode for the purposes of the present invention. With this embodiment, it is contemplated that the entire drill bit of FIG. 1, including the shank 22 but not including the pin 12, will be subjected to the gas nitriding process to make the entire exposed portion of the drill bit of FIG. 1 electro-negative with respect to steel. As stated previously, by treating the cross-over sub 40, for example, with the galvanizing process, the cross-over sub itself is electro-positive with respect to steel. In the operation of the drill bit and the cross-over sub 40 illustrated collectively in FIGS. 1-3, the drill cuttings associated with drilling through clay or shale formations will adhere to the cross-over sub 40 and not to the drill bit itself.

In an alternative embodiment of the invention, the entire drill bit illustrated in FIG. 1 can be made electro-negative with respect to steel, for example, by using the gas nitriding process, and the cross-over sub 40 can be left untreated, i.e., not exposed to a process making it electro-positive with the respect to steel, and nonetheless serve as a sacrificial anode because of its being fabricated of steel and the drill bit fabricated of steel treated with the gas nitriding process to make it electro-negative with respect to steel.

It should be appreciated that the MWD logging tool 50 is itself fabricated from steel and will serve as a sacrificial anode in those instances were the drill bit is threaded directly into the bottom end of the logging tool 50, without the use of an intervening cross-over sub. In many cases, there is a steel drill collar located beneath the logging instrument 50 having a pin end at its lower end (not illustrated) which necessitates the cross-over sub 40 being of the so called box-box variety, i.e., an apparatus having both of its ends with female threads for receiving the drill bit pin and the male end of the drill pipe.

Figure 4:
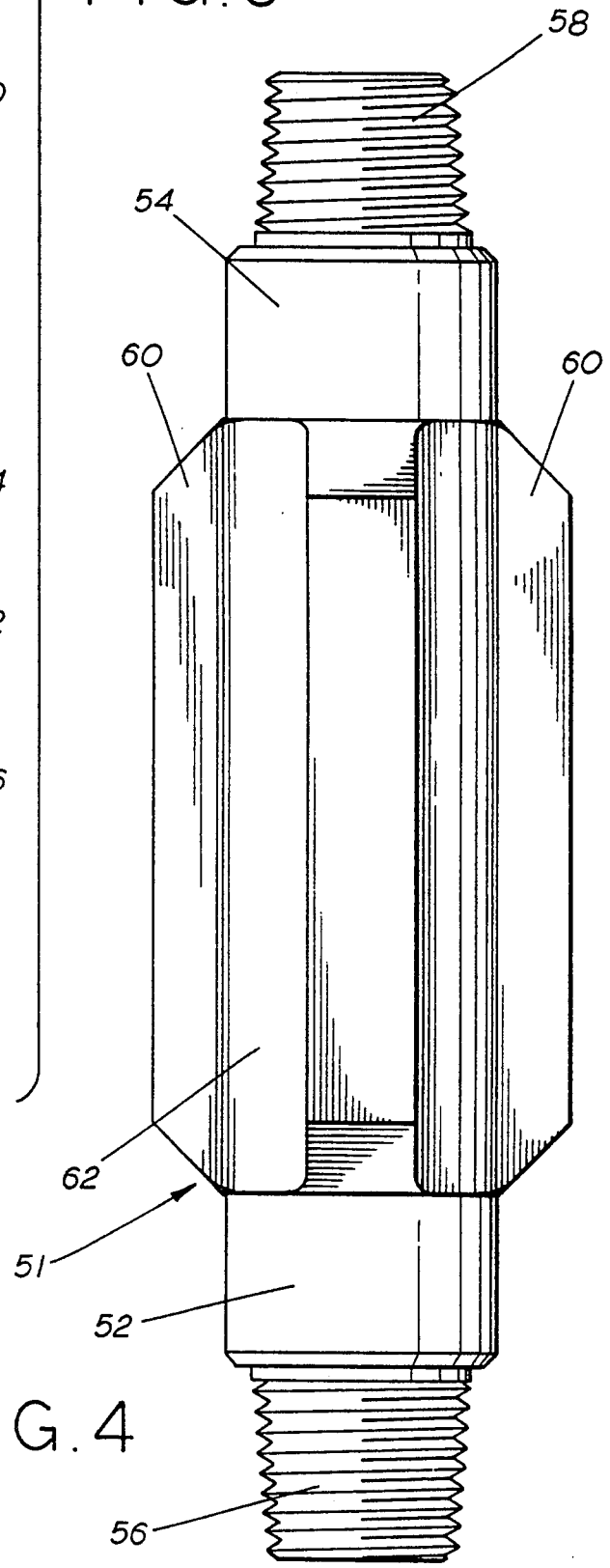
FIG. 4 is an elevated, pictorial view of a drilling stabilizer in accord with the present invention.

Referring now to FIG. 4, there is illustrated an alternative embodiment of the present invention, in which an otherwise conventional drilling stabilizer 51 is illustrated. Stabilizer 51 has a lower shank 52 and an upper shank 54. The shank 52 is connected to a lower pin end 56, whereas the shank 54 is connected to an upper pin end 58. The stabilizer 51 has a plurality of blades 60, for example, four, which ride up against the earth formation (not illustrated) during the drilling process in a manner well known in the art. Selected portions of the stabilizer 51 can be plated, to make them either electro-negative or electro-positive with respect to steel, to reduce the balling of mud within the stabilizer during the drilling process. For example, the channels 62 between the respective blades 60 can be treated with a gas nitriding process to make the channels electro-negative with respect to steel and the shanks 52 and 54 can be treated to make them electro-positive, for example, using the galvanizing process, to thereby eliminate or substantially lessen the balling of the mud between the blades 60 in the channels 62, and instead cause the mud to ball against the shanks 52 and 54. Although not illustrated, a conventional reamer can be similarly treated as above set forth with respect to the stabilizer.

Since it is desirable that the balled mud appear on the upper most shank 54, as contrasted with the lower most shank 52, during the drilling process, it may be preferable to coat only the upper shank 54 to make it electro-positive with respect to steel and to either leave the shank 52 alone or to coat it with a gas nitriding process to make it electro-negative with respect to steel, to thus result in the drill cuttings preferentially sticking only to the shank 54 as the drill string and the stabilizer 51 progressively drill deeper into the earth.

Figure 5:
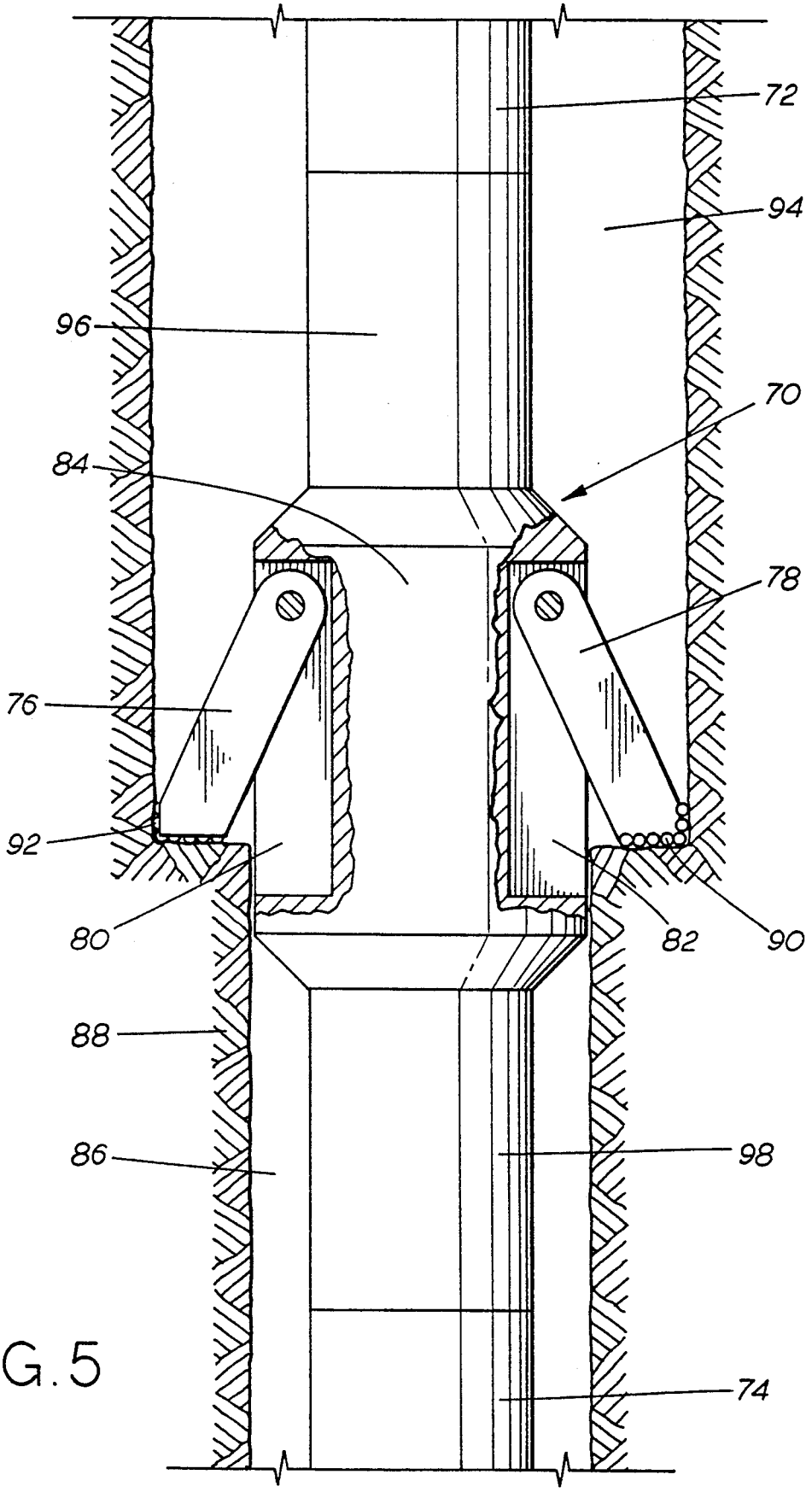
FIG. 5 is an elevated, schematic view of a well bore enlarging apparatus threaded in place between a pair of drill collars in accord with the present invention.

Referring now to FIG. 5, there is illustrated, quite schematically, a well bore enlarging apparatus 70 in place within a drill string between a pair of drill collars 72 and 74. The hole enlarging apparatus 70 has threaded box ends in its upper and lower end to receive the pin ends of drill collars 72 and 74, respectively. The drill collar 72 and 74 are typically manufactured of steel.

The hole enlarging apparatus 70 is itself also manufactured of steel and has two or more retractable cutting assemblies 76 and 78 which reside in the retracted position, within the two or more cavities 80 and 82, the cavities being within the enlarged section 84 of the apparatus 70. It should be appreciated that the apparatus illustrated in FIG. 5 is highly schematic in nature and is intended only to demonstrate the present invention, which is used to make one or more parts of the apparatus of FIG. 5 electro-negative and/or electro-positive with respect to steel. If desired, the apparatus 70 can be otherwise manufactured in accord with the teaching of U.S. Pat. No. 4,589,504, especially as is illustrated in FIG. 2 of that patent, the patent being assigned to Baroid Technology, Inc., the assignee of the present application.

Suffice it to say at this point that the apparatus 70 is run into the well bore 86 in an earth formation 88 until such time as it is desired to enlarge the borehole at some specific depth of interest. At such depth of interest, the plurality of arms 76 and 78 are expanded outwardly and use the cutters 90 and 92 to enlarge the diameter of the borehole, for example, as is illustrated with the borehole 94 having a greater diameter than the borehole 86.

Whenever a borehole enlarging apparatus such as the apparatus illustrated in FIG. 5 encounters clay or shale formations, it is not uncommon that the plurality of cavities 80 and 82 become clogged with drill cuttings, making it very difficult to retract the cutter arms 76 and 78 to pull the drill string out of the hole.

To overcome this problem, the enlarged section 84 of the apparatus 70 is treated, including the interior surfaces of the cavities 80 and 82 and the cutting arms 76 and 78 with the gas nitriding process to make them electro-negative with respect to steel. In one embodiment of the present invention, the reduced diameter shanks 96 and 98 are not exposed to the gas nitriding process and thus have the electro-negativity of steel, causing the cuttings from the shale formations to preferentially stick to the shanks 96 and 98, instead of sticking within the enlarged section 84 of the apparatus 70.

As an alternative embodiment of the invention, one or both of the shanks 96, 98 can be made electro-positive with respect to steel, for example, with the galvanizing process involving dipping of the one or both shanks into molten zinc.

As another alternative embodiment of the present invention, the entire apparatus 70, including the shanks 96 and 98, can be exposed to the gas nitriding process and utilize the fact of the steel drill collars 72 and 74 being the sacrificial anodes, thus causing the drill cuttings to preferentially stick to such drill collars.

Figure 6:
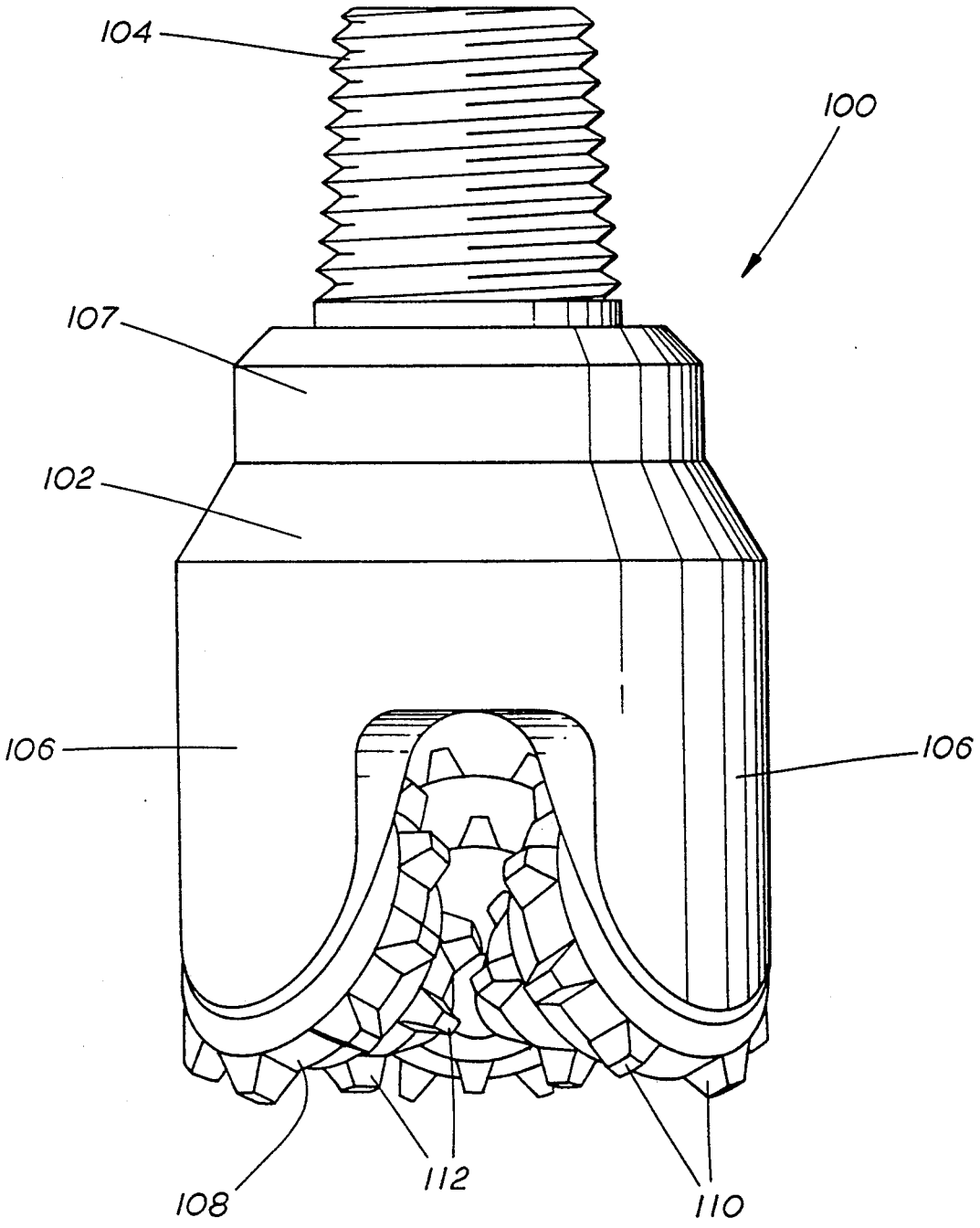
FIG. 6 is an elevated, pictorial view of a rotary rock bit in accord with the present invention.

Referring now to FIG. 6, an otherwise conventional rotary cutter-type drill bit is shown generally at 100. This type of bit is generally referred to in the industry as a "rock bit". The rotary bit structure 100 generally comprises a steel body structure 102 having a threaded upper extremity 104 for attachment of the drill bit to the lower section of a drill collar (not illustrated) or the cross over sub 40 illustrated in FIG. 3 herein. In a manner well known in the art, the portion of the bit intermediate the cutting end of the bit and the threaded pin 104 is a section (unnumbered) defining an exterior peripheral stabilizer surface. The body structure 102 also includes a plurality of depending cutter supports legs 106 each supporting a rotary cutting element such as shown at 108 and 110, each having a plurality of teeth 112 formed thereon to provide optimal engagement between the teeth of each of the cutter elements and the formation being drilled. The rotary drill bit 100 in FIG. 6 is conventional, and can be constructed, if desired, in accord with U.S. Pat. No. 4,157,122. Although the roller bit 100 is illustrated as having a pair of rotary cutting elements 108 and 110, the present invention has equal applicability to so called tri-cone roller bits having three such cutting elements, a family of rock bits which are well known.

The present invention contemplates that the cutter supports legs 106, as well as the rotary cutting elements 108 and 110, will be subjected to the gas nitriding process to make them electro-negative with respect to steel and that the shank portion 107 will be left untreated to thereby act as a sacrificial anode during the drilling process, thus causing the drill cuttings to preferentially stick to the shank 107 instead of the remainder of the bit.

As an alternative embodiment of the invention, the shank 107 can be galvanized or otherwise treated to make it electro-positive with respect to steel to create an even greater difference between the shank 107 and the remainder of the bit with regard to electro-negativity.

Figure 7:
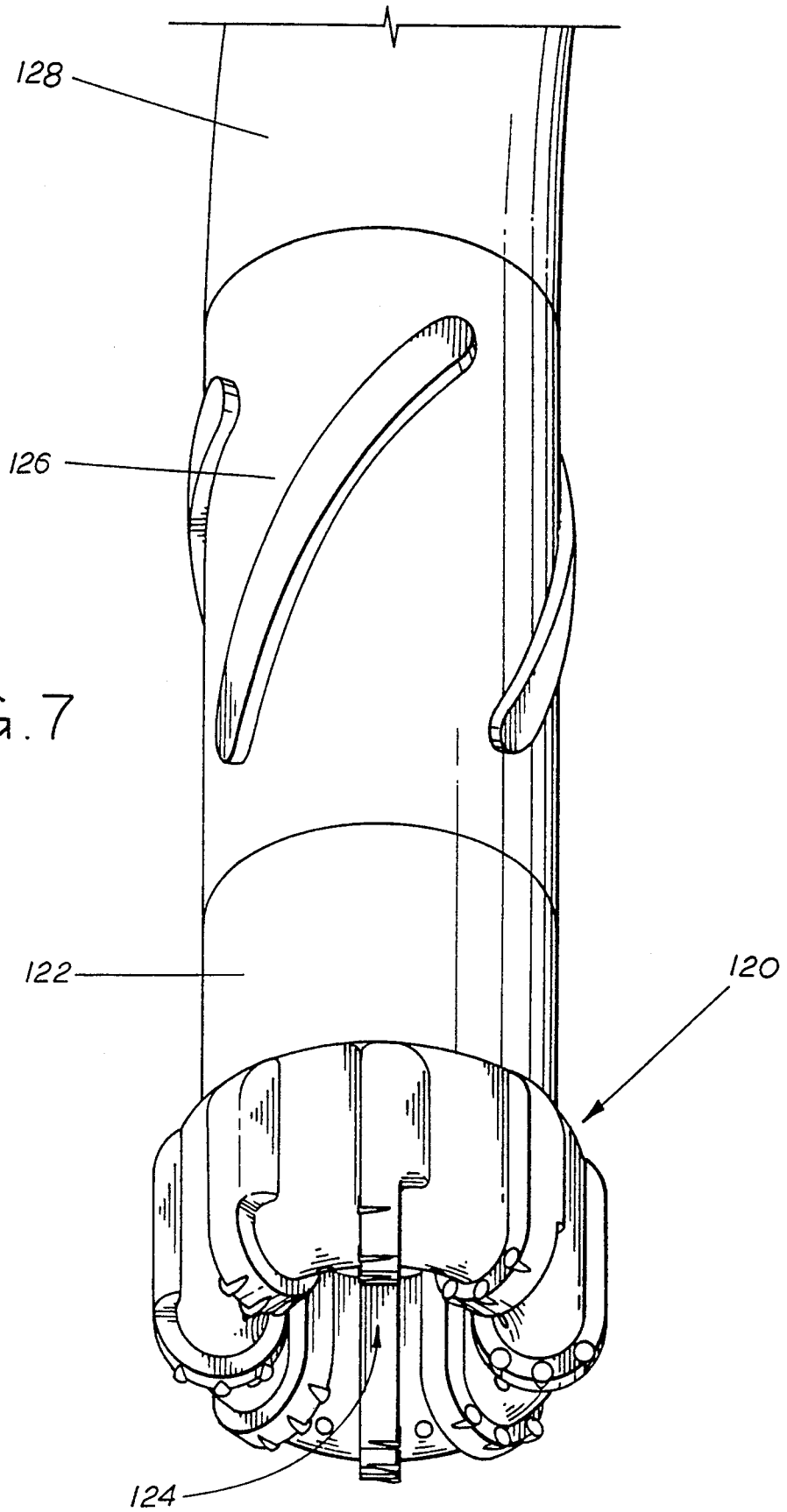
FIG. 7 is an isometric, pictorial view of a coring bit in place at the lower end of a drill string in accord with the present invention.

Referring now to FIG. 7, there is illustrated a conventional coring bit 120 having a shank 122 which is threadedly engaged with a stabilizer 126 and above which is located a core barrel 128 as is well known in the art. The lower portion of the coring bit 120 has an opening 124 for receiving the core sample, again as is well known in the art.

The present invention contemplates the exposure of the coring bit 120 to the gas nitriding process, leaving the shank 122 untreated to therefore allow it to be used as a sacrificial anode and thus causing preferential sticking of the drill cuttings to the shank 122 instead of the coring bit 120. If desired, in an alternative embodiment of the invention, the shank 122 can also be subjected to the gas nitriding process and the utilization of the stabilizer 126 as the sacrificial anode. In a manner well known in the art, the portion intermediate the cutting face of the bit 120 and the shank 122 is provided (unnumbered) to form an exterior peripheral stabilizer surface.

If desired, the interior portion of the coring bit 120 and the core barrel 128, leading from the opening 124, can be selectively treated with processes rendering selected portions thereof either electro-negative or electro-positive with respect to steel to eliminate or lessen mud sticking at those various locations as desired. Since the core which enters the opening 124 is itself identical in many respects to the drill cuttings, those skilled in the art can through very simple and straight forward experiments determine which of the interior parts should be treated to make them electro-negative and which should be treated, if any, to make them electro-positive with respect to steel.

Referring again to FIGS. 1 and 7, it should be appreciated that the importance of the invention resides in there being a potential difference between the area to be protected from mud balling and the sacrificial anode. For example, in FIG. 1, if the portion 30 of the bit 10 is not subjected to the gas nitriding process, while subjecting the shank 22 to a galvanizing process to make it electro-positive with respect to steel, the mud balling on the bit is substantially reduced.

Similarly, the entire bit 10 can be left untreated, i.e., not caused to be made electro-negative with respect to steel, but by causing the cross-over sub 40 to be electro-positive with respect to steel, the cross-over sub is thus encouraged to accept the drill cuttings, while sparing the bit surfaces from bit balling.

In a similar manner, the various pieces of equipment in FIG. 3–7 can be processed.

What is claimed is:

1. A drill bit adapted to be connected to a drill string, comprising:

a steel bit body having a first end defining a cutting face, said cutting face having a plurality of cutters mounted therein;

said steel bit body having a second end defining a tubular body adapted to be threaded into a drill string; and said steel bit body having a portion thereof intermediate said first and second ends defining an exterior peripheral stabilizer surface, said drill bit being characterized by said cutting face being electro-negative with respect to the standard reduction potential of steel.

2. The drill bit according to claim 1, being characterized further by said cutting face having been subjected to a gas nitriding process to cause said cutting face to be electro-negative with respect to the standard reduction potential of steel.

3. The drill bit according to claim 1, being characterized further by said intermediate portion of said drill bit also being electro-negative with respect to the standard reduction potential of steel.

4. The drill bit according to claim 3, being characterized further by said intermediate portion having been subjected to a gas nitriding process to cause said intermediate portion to be electro-negative with respect to the standard reduction potential of steel.

5. The drill bit according to claim 1, being characterized further by at least a portion of said second end of said drill bit defining a tubular body being electro-positive with respect to the standard reduction potential of steel.

6. The drill bit according to claim 5, being characterized further by said at least a portion of said second end having been subjected to a galvanizing process to cause said at least a portion of said second end to be electro-positive with respect to the standard reduction potential of steel.

7. The drill bit according to claim 1, being characterized further by at least a portion of said second end of said drill bit defining a tubular body having the same degree of electro-negativity as the standard reduction potential of steel.

8. The drill bit according to claim 7, wherein said second end of said drill bit defining a tubular body comprises a shank and a threaded pin.

9. A portion of a drill string for drilling an earth borehole, comprising in combination:

a steel bit body having a first end defining a cutting face, said cutting face having a plurality of cutters mounted therein;

said steel bit body having a second end defining a tubular body adapted to be threaded into a steel cross over sub, and a steel cross-over sub being adapted to threadedly mate with said second end of said drill bit, said combination being characterized by at least a portion of said steel bit body being electro-negative with respect to the standard reduction potential of steel.

10. The combination according to claim 9, being characterized further by said at least a portion of said steel bit body having been subjected to a gas nitriding process to cause said at least a portion of said steel bit body to be electro-negative with respect to the standard reduction potential of steel.

11. The combination of claim 10, being further characterized by at least a portion of said cross-over sub being electro-positive with respect to the standard reduction potential of steel.

12. The combination according to claim 11, being characterized further by said at least a portion of said cross-over sub being subjected to a galvanizing process to cause said at least a portion of said cross-over sub to be electro-positive with respect to the standard reduction potential of steel.

13. The combination of claim 9, being further characterized by at least a portion of said cross-over sub having the same degree of electro-negativity as the standard reduction potential of steel.

14. A drill bit adapted to be connected to a drill string, comprising:

a steel bit body having a first end having a plurality of rotatable cutting elements mounted thereto;

said steel bit body having a second end defining a tubular body adapted to be threaded into a drill string; and said steel bit body having a portion thereof intermediate said first and second ends defining an exterior peripheral stabilizer surface, said drill bit being characterized by said first end of said bit body being electro-negative with respect to the standard reduction potential of steel.

15. The drill bit according to claim 14, being characterized further by said intermediate portion of said drill bit also being electro-negative with respect to the standard reduction potential of steel.

16. The drill bit according to claim 15, being characterized further by said first end and said intermediate portion having been subjected to a gas nitriding process to cause said first end and said intermediate portion to be electro-negative with respect to the standard reduction potential of steel.

17. The drill bit according to claim 14, being characterized further by at least a portion of said second end of said drill bit defining a tubular body being electro-positive with respect to the standard reduction potential of steel.

18. The drill bit according to claim 17, characterized further by said at least a portion of said second end having been subjected to a galvanizing process to cause said at least a portion of said second end to be electro-positive with respect to the standard reduction potential of steel.

19. The drill bit according to claim 14, being characterized further by at least a portion of said second end of said drill bit defining a tubular body having the same degree of electro-negativity as the standard reduction potential of steel.

20. The drill bit according to claim 14, wherein said second end of said drill bit defining a tubular body comprises a shank and a threaded pin.

21. A portion of a drill string for drilling an earth borehole, comprising in combination:

a steel bit body having a first end having a plurality of rotatable cutting elements mounted thereto;

said steel bit body having a second end defining a tubular body adapted to be threaded into a steel cross over sub, and a steel cross-over sub being adapted to threadedly mate with said second end of said drill bit, said combination being characterized by at least a portion of said steel bit body being electro-negative with respect to the standard reduction potential of steel.

22. The combination according to claim 21, being characterized further by said at least a portion of said steel bit body having been subjected to a gas nitriding process to cause said at least a portion of said steel bit body to be electro-negative with respect to the standard reduction potential of steel.

23. The combination of claim 22, being further characterized by at least a portion of said cross-over sub being electro-positive with respect to the standard reduction potential of steel.

24. The combination according to claim 23, being characterized further by said at least a portion of said cross-over sub having been subjected to a galvanizing process to cause said at least a portion of said cross-over sub to be electro-positive with respect to the standard reduction potential of steel.

25. A drill coring bit adapted to be connected to a drill string, comprising:

a steel bit body having a first end defining a coring face, said coring face having a plurality of cutters mounted therein and a center orifice for receiving a core;

said steel bit body having a second end defining a tubular body adapted to be threaded into a drill string; and said steel bit body having a portion thereof intermediate said first and second ends defining an exterior peripheral stabilizer surface, said coring bit being characterized by said coring face being electro-negative with respect to the standard reduction potential of steel.

26. The drill bit according to claim 25, being characterized further by said intermediate portion of said coring bit also being electro-negative with respect to the standard reduction potential of steel.

27. The coring bit according to claim 25, being characterized further by at least a portion of said second end of said coring bit defining a tubular body being electro-positive with respect to the standard reduction potential of steel.

28. The coring bit according to claim 25, being characterized further by at least a portion of said second end of said coring bit defining a tubular body having the same degree of electro-negativity as the standard reduction potential of steel.

29. The coring bit according to claim 25, wherein said second end of said coring bit defining a tubular body comprises a shank and a threaded pin.

30. The coring bit according to claim 25, being characterized further by said coring face having been subjected to a gas nitriding process to cause said coring face to be electro-negative with respect to the standard reduction potential of steel.

31. The coring bit according to claim 26, being characterized further by said intermediate portion having been subjected to a gas nitriding process to cause said intermediate portion to be electro-negative with respect to the standard reduction potential of steel.

32. The coring bit according to claim 27, being characterized further by said at least a portion of said second end having been subjected to a galvanizing process to cause said at least a portion of said second end to be electro-positive with respect to the standard reduction potential of steel.

33. A stabilizer for use in a drill string, comprising:

a steel stabilizing body having first and second ends adapted to be threaded into a drill string;

said steel stabilizing body having a portion intermediate said first and second ends sized to bear against the borehole wall, said intermediate portion being electro-negative with respect to the standard reduction potential of steel.

34. The stabilizer according to claim 33, wherein each of said first and second ends comprises a shank and a threaded pin.

35. The stabilizer according to claim 33, wherein each of said first and second ends comprises a shank having female threads.

36. The stabilizer according to claim 33, wherein said first end comprises a shank and a threaded pin, and said second end comprises a shank having female threads.

37. The stabilizer according to claim 33, being characterized further by said intermediate portion having been subjected to a gas nitriding process to cause said intermediate portion to be electro-negative with respect to the standard reduction potential of steel.

38. The stabilizer according to claim 33, being characterized further by at least a portion of at least one of said first and second ends being electro-positive with respect to the standard reduction potential of steel.

39. The stabilizer according to claim 38, being characterized further by said at least a portion of at least one of said first and second ends having been subjected to a galvanizing process to cause said at least a portion of at least one of said first and second ends to be electro-positive with respect to the standard reduction potential of steel.

40. The stabilizer according to claim 38, being characterized further by said at least a portion of each of said first and second ends having been subjected to a galvanizing process to cause said at least a portion of each of said first and second ends to be electro-positive with respect to the standard reduction potential of steel.

41. The stabilizer according to claim 33, being characterized further by said at least a portion of at least one of said first and second ends having the same degree of electro-negativity as the standard reduction potential of steel.

42. A borehole enlarging apparatus for use in a drill string, comprising:

a steel body having first and second ends adapted to be threaded into a drill string;

said steel body having expandable cutter arms mounted in a portion of said steel body intermediate said first and second ends, said intermediate portion being electro-negative with respect to the standard reduction potential of steel.

43. The borehole enlarging apparatus according to claim 42, wherein each of said first and second ends comprises a shank and a threaded pin.

44. The borehole enlarging apparatus according to claim 42, wherein each of said first and second ends comprises a shank having female threads.

45. The borehole enlarging apparatus according to claim 42, wherein said first end comprises a shank and a threaded pin, and said second end comprises a shank having female threads.

46. The borehole enlarging apparatus according to claim 42, being characterized further by said intermediate portion having been subjected to a gas nitriding process to cause said intermediate portion to be electro-negative with respect to the standard reduction potential of steel.

47. The borehole enlarging apparatus according to claim 42, being characterized further by at least a portion of first and second ends being electro-positive with respect to the standard reduction potential of steel.

48. The borehole enlarging apparatus according to claim 47 being characterized further by said at least a portion of at least one of said first and second ends having been subjected to a galvanizing process to cause said at least a portion of at least one of said first and second ends to be electro-positive with respect to steel.

49. The borehole enlarging apparatus according to claim 47, being characterized further by said at least a portion of each of said first and second ends having been subjected to a galvanizing process to cause said at least a portion of each of said first and second ends to be electro-positive with respect to the standard reduction potential of steel.

50. The borehole enlarging apparatus according to claim 42, being characterized further by said at least a portion of at least one of said first and second ends having the same degree of electro-negativity as the standard reduction potential of steel.

51. A downhole apparatus adapted to be connected in a drill string, comprising:

a steel body;

said steel body having at least one end adapted to be threadedly connected to said drill string, said apparatus being characterized by at least a portion of said steel body being electro-negative with respect to the standard reduction potential of steel.

52. The downhole apparatus according to claim 51, being characterized further by at least a portion of said at least one end having the same degree of electro-negativity as the standard reduction potential of steel.

53. The downhole apparatus according to claim 51, being characterized further by at least a portion of said at least one end being electro-positive with respect to the standard reduction potential of steel.

54. A downhole apparatus combination adapted to be connected in a drill string, comprising:

a first steel body, said first steel body being adapted to be threadedly connected into said drill string;

a second steel body, said second steel body being adapted to be threadedly connected into said drill string, said combination being characterized by at least a portion of one of said bodies being electro-negative with respect to the standard reduction potential of steel.

55. A downhole apparatus combination adapted to be connected in a drill string, comprising:

a first steel body, said first steel body being adapted to be threadedly connected into said drill string;

a second steel body, said second steel body being adapted to be threadedly connected into said drill string, said combination being characterized by at least a portion of one of said bodies being electro-positive with respect to the standard reduction potential of steel.

56. A downhole apparatus combination adapted to be connected in a drill string, comprising:

a first steel body, said first steel body being adapted to be threadedly connected into said drill string;

a second steel body, said second steel body being adapted to be threadedly connected into said drill string, said combination being characterized by at least a portion of said first body being electro-negative with respect to the standard reduction potential of steel, and by at least a portion of said second body being electro-positive with respect to the standard reduction potential of steel.

57. A downhole apparatus adapted to be connected in a drill string, comprising:

a steel body;

said steel body having at least one end adapted to be threadedly connected to said drill string, said apparatus being characterized by at least a portion of said steel body being electro-positive with respect to the standard reduction potential of steel.

58. The downhole apparatus according to claim 57, being characterized further by at least a portion of said steel body having the same degree of electro-negativity as the standard reduction potential of steel.

59. The downhole apparatus according to claim 57, being characterized further by at least a portion of said steel body being electro-negative with respect to the standard reduction potential of steel.

* * * * *